United States Patent [19]

Henke

[11] 4,063,998

[45] Dec. 20, 1977

[54] FOURDRINIER FABRIC HAVING CONTACTING LONGITUDINAL THREADS

[76] Inventor: Heinz W. Henke, Ernst Reuter Str. 4, Dueren, Germany, D-5160

[21] Appl. No.: 702,140

[22] Filed: July 2, 1976

[30] Foreign Application Priority Data

July 5, 1975 Germany ..... 2530110

[51] Int. Cl.[2] ..... D21F 1/10

[52] U.S. Cl. ..... 162/348; 139/425 A; 162/DIG. 1

[58] Field of Search ..... 162/348, DIG. 1; 139/425 A

[56] References Cited

U.S. PATENT DOCUMENTS

| | | | |
|---|---|---|---|
| 1,934,643 | 11/1933 | Rafton | 139/425 A |
| 2,551,175 | 5/1951 | Smith | 162/DIG. 1 |

*Primary Examiner*—Richard V. Fisher

[57] ABSTRACT

A dehydration element for the fourdrinier part of a paper making machine is a metal or plastic twill-weave binding fabric in which the longitudinal (warp) threads bound to the woof threads are closely spaced to each other up to the point where the longitudinal threads are tightly pressed together. The result is a substantially closed mesh in which water drawn from the pulp passes through the element by capillary action in the fine channels and diagonal openings of the cloth. Preferably the cloth is an unevenly bound twill-weave with its paper side unifilarly bound and its machine side multifilarly bound.

5 Claims, 4 Drawing Figures

FOURDRINIER FABRIC HAVING CONTACTING LONGITUDINAL THREADS

Figure 1:
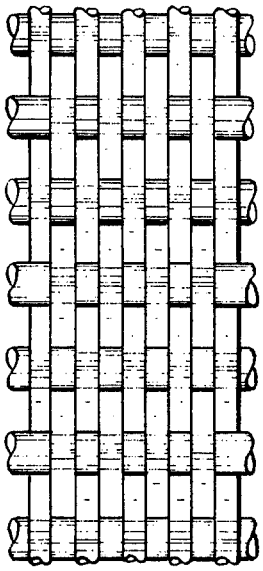

The invention is concerned with a dehydration element for the fourdrinier part of paper machines consisting of metal and/or plastic wire fabric in a twill-weave.

In the manufacture of paper, one has always set out from the assumption that the dehydration of the supplied paper pulp can satisfactorily and quickly be accomplished only with open-meshed fabrics - therefore the term "sieve" or "sieve netting" respectively.

The known wire fabrics used as paper-machine sieves have therefore independent of the weave, one feature in common, which is that they have an open area which - compare for instance Karl Keim, Sieb und Filz (Sieve and Felt), Biberach 1968, page 21 -is in the order of magnitude of 20% and more.

An exception is the so-called triple sieves (compare Keim loc. cit. page 24) which are woven in a dense linen weave (basket weave) in which the warp always consists of a group of three parallel wires.

This kind of sieve is however usable only for extremely thin papers, for instance cigaret paper, which hardly or not at all need a dehydration by suction. Besides, the fabrics have to consist of the finest (and therefore delicate) wires in order that the thin paper sheet can be formed at all. Furthermore, the wires have to be in these fabrics as closely set as possible in order to offer by the basket weave a sufficiently fine screening surface. Their machine side is correspondingly weak and they are not suitable, for instance, for the manufacture of standard printing paper.

Widely used are the three-leaved twill sieves, since these offer a larger contact surface between the machine side of the fabric and the suction strips than for instance wire fabrics in linen-weave. The warp wires run in this twill-weave alternately underneath two woof wires on the underside (the machine side) of the sieve and come only after each third woof wire to the upper side. Thereby, the specific load is reduced, which reduces the rate of wear.

According to the present state of technology, a further increase in the wear-resistance of known open mesh paper machine metal sieves cannot be expected even by use of other weaves or other metal wire materials. On the other hand, the demands on the wear-resistance become higher and higher because the speeds of the paper machines are continuously increased and constructive improvements of the paper machines cannot make up for the increased load.

It has now been surprisingly found that a high dehydrating performance could also be achieved if the water is drawn off from the supplied pulp under the influence of gravity or by the underpressure of the suction elements respectively not through an open mesh but by the capillary force of fine channels and diagonal openings which are formed by appropriate construction of the wire cloth.

It is the task of the invention to create a dehydration element of the kind described above which with a good dehydration efficiency offers an improved wear-resistance on the machine side than known paper-machine sieve.

This problem is solved in that the group of longitudinal threads of the fabric are lying next to each other as closely as possible to the point where they are tightly pressed together.

In other words, according to the invention a closed mesh wire cloth or fabric is striven for. The uniting of the longitudinal (warp) threads takes place by means of multiple-warp weaving, known in itself, whereas the number of the longitudinal threads, with the thread gauge remaining constant, is attainable by the smallest possible spacing of the longitudinal-thread twill groups. All together a thread increase of 60% can be achieved.

The dehydration element according to the invention is in a construction as an unevenly jointed twill weave unifilarly bound on its paper side, so that it marks exclusively as a point screen. The sum of the longitudinal-thread diameters can in this case advantageously be greater than the width of the web.

According to a particularly suitable form of execution of the invention, an unevenly bound twill-weave of the fabric has multi-filarly woven threads on its machine side, which are for the major part in contact with each other, whereby they form an enlarged rolling surface which is thus less subject to wear, and unifilarly woven threads on its paper side which provides favorable smoothness and printability to the paper.

In the case of an evenly bound twill-weave, the sum of the longitudinal-thread diameters is suitably equal to, or larger than the width of the web.

The cross or woof wires of the dehydration element according to the invention lie preferably stretched in the cross section of the fabric.

The number of the dehydrating openings of the fabric is proportional to the number of threads; the number of threads according to the invention is increased by 66 to 100%, which accounts among other advantages for the good dehydration performance.

The closed-mesh structure brings about additionally an important improvement for the finished paper. Fiber material and fillers of the liquid paper pulp are retained to a larger extent in the paper sheet. The reduced quantity of filler in the waste water reduces further the wear on the machine side.

Another advantage of the fabric according to the invention lies in the structure of its upper or paper side. This side of a paper-machine sieve is reflected in the paper sheet, which affects the smoothness and printability of the paper. The previously used sieves with linen-weave binding produced, due to their point screen, in this respect the most favorable results. The line pattern of the twill-weave sieves of today cause however considerable difficulties with many of the paper qualities.

The densely threaded twill weave according to the present invention shows in contrast on its paper side a linen structure with point screen.

Since the tensile stress in the paper-machine sieve depends on the resistance which the suction of the machine produces as a constant factor, the greater number of longitudinal threads of the fabric according to the invention reduces moreover the specific stress in the individual thread. The longitudinal thread whose diameter decreases gradually due to wear in the operation can therefore resist the tensile stress for a longer period of time than previously. As has been found, the useful life of the fabric according to the invention has, due to the stress reduction and the enlarged wear mass, been extended to double its previous length. The reduced specific tensile stress increases moreover the durability of the connecting seam and prevents, furthermore, the expansion of badly worn bulging spots, as was the case with prior open mesh sieves in which transverse breaks quickly extended to make the entire fabric unserviceable.

An additional advantage of the invention turns out to be that the contact pressure on the individual thread above the abrading suction elements is like the tensile stress also reduced. Digging of the suction elements during a constant straight run into the surface of the dehydration elements, to destroy them and eventually wedge themselves and tear is thereby prevented. The fabric according to the invention does therefore not have to be woven like the previous meshed sieves with laterally oscillating displacements ("swinging").

Also the permanent stretching of the fabric according to the invention is in continuous use considerably reduced due to the increased sum total of the longitudinal-thread diameters. It can therefore advantageously be run with less prestressing.

The paper-machine fabric according to the present invention offers further technological advantages in that its woof wires are not offset to the surface of the fabric but lie stretched in its cross section. They have therefore no influence on the structure of the outer surface of the fabric. For this reason they can be modified in any desired way without altering their fine point (dot) pattern. If their diameter is increased, the lateral rigidity of the fabric is increased as a protection against pleating of the dehydrating belt and it becomes resistant to buckling. If the same material is selected for them which is used for the warp wires, electrolytic corrosion in the fabric is avoided. Such improvements are in the open-meshed twill sieves possible only at the cost of the paper marking since the paper filter support is reduced.

The smooth unbent woof wires effect, moreover, in cooperation with the twill-weave binding, a very desirable over-all flexibility of a new kind in the sieve fabric according to the invention. This induces according to practical experience unavoidable bulges, caused by the impression of fabric kinks, to recede automatically to a large extent. Premature wearing of holes in the fabric is also prevented.

Figure 3:
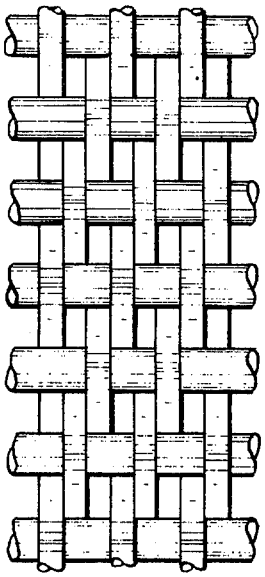
Figure 2:
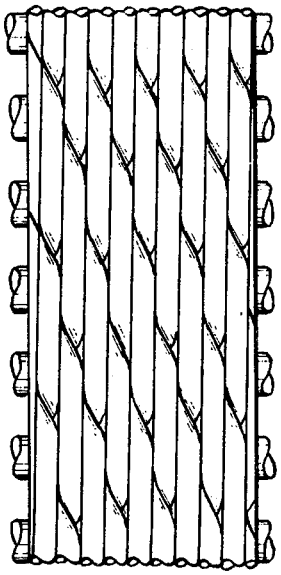
Figure 4:
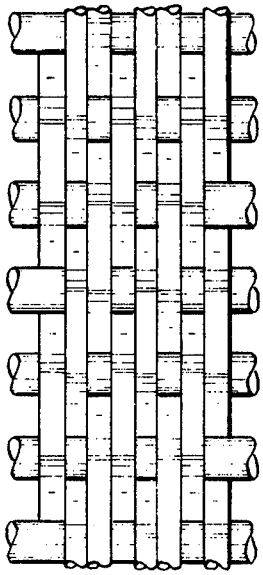

The invention is further explained in the following description of preferred embodiments and on the basis of the drawings by way of example:

The FIGS. 1 and 2, 3 and 4 show schematically two different fabrics according to the invention, in which illustrations the woof wires are represented horizontally and the warp wires vertically, and showing in the FIGS. 1 and 3 the paper side, and in the FIGS. 2 and 4 the machine side.

The FIGS. 3 and 4 show a fabric in unevenly jointed twill-weave binding, i.e., multifilar on the machine side and unifilar on the paper side; one recognizes that a point screen results. The density of this point screen increases by up to 50% if — as shown in the FIGS. 1 and 2 — the number of the longitudinal threads is increased up to a completely tight contact in the intersections. By the same percentage is increased the wire mass subject to wear on the machine side of the fabric. By the construction of a paper-machine sieve whose total of the longitudinal-thread diameters is greater than the width of the web of the fabric, running time and marking property can therefore be arbitrarily controlled.

In the production of coarser kinds of paper the increased running strength of the fabric is indeed frequently important, not however the marking. In such cases can the new densely threaded twill fabric also be made evenly jointed.

By expansion and thickness tolerance of the longitudinal threads slot-shaped gaps between individual longitudinal threads can form in the fabric or groups of threads. This depends on the weaving method. Thereby, it changes in no way the structural character of the novel paper-machine fabric of the inventions.

I claim:

1. A dehydration element for the fourdrinier part of paper making machines has a paper side and a machine side and comprises longitudinal threads bound to woof threads with said longitudinal threads being closely spaced together so that adjacent ones of said longitudinal threads contact each other to provide a closed mesh fabric with fine channels therethrough defined by said longitudinal and woof threads, said fabric being an unevenly bound twill-weave with the paper side of the fabric being unifilarly bound.

2. The dehydration element of claim 1 in which the longitudinal threads are so tightly pressed together that the sum of the diameters of said longitudinal threads is greater than the width of the web of said fabric.

3. The dehydration element of claim 1 wherein said longitudinal threads are multifilarly bound on the machine side of said fabric and are in contact with each other on said machine side.

4. The dehydration element of claim 1 wherein said threads are made of metal.

5. The dehydration element of claim 1 wherein said threads are made of plastic.

* * * * *